US005488447A

United States Patent [19]

Patton et al.

[11] Patent Number: 5,488,447

[45] Date of Patent: Jan. 30, 1996

[54] SYSTEM AND METHOD FOR TRANSFERRING A FLUID BETWEEN A CONTAINER AND AN ASSOCIATED APPARATUS FOR USING THE FLUID

[75] Inventors: David L. Patton, Webster; Clark E. Harris, Fairport; John H. Rosenburgh, Hilton, all of N.Y.

[73] Assignee: Eastman Kodak Company, Rochester, N.Y.

[21] Appl. No.: 363,102

[22] Filed: Dec. 22, 1994

[51] Int. Cl.[6] ..... G03D 13/00

[52] U.S. Cl. ..... 354/298; 354/324; 366/142; 222/23

[58] Field of Search ..... 354/322–324, 354/298; 222/23; 366/142, 150

[56] References Cited

U.S. PATENT DOCUMENTS

| | | | |
|---|---|---|---|
| 4,197,942 | 4/1980 | Gacki et al. | 206/219 |
| 4,217,054 | 8/1980 | Gacki et al. | 366/150 |
| 4,227,818 | 10/1980 | Gacki et al. | 366/142 |
| 4,533,225 | 8/1985 | Shiga | 354/322 |
| 4,928,900 | 5/1990 | Beery | 242/348.4 |
| 4,958,666 | 9/1990 | Kocourek et al. | 141/114 |
| 5,031,797 | 7/1991 | Boris et al. | 222/23 |
| 5,070,351 | 12/1991 | Vanover et al. | 354/299 |

OTHER PUBLICATIONS

Photographic Technology Division Report A–478, "Cassette–Load Processor for a Recordak Microfilm" Arthur L. Floran and Harold D. Lowry, Eastman Kodak Company, Aug. 16, 1967.

Operating the Kodak Minilab System 25, vol. 3, Publication Part No. 314089, Eastman Kodak Company, 1987.

*Primary Examiner*—D. Rutledge

*Attorney, Agent, or Firm*—Charles E. Snee, III

[57] ABSTRACT

A system and method are taught for transferring fluids between a container and an associated apparatus for using the fluid. Interface members (52, 68; 86, 88) on the container (80, 82) cooperate with sensor probe assemblies (54, 70; 90–108) and a controller (56) in the associated apparatus to indicate the status of the container as full or partially full of fresh liquid, emptied of fresh liquid, or full or partially full of effluent liquid. The likelihood of delivering the wrong liquid to the associated apparatus is minimized. The invention is particularly useful for delivery of liquid chemicals to a photographic processor apparatus.

16 Claims, 7 Drawing Sheets

FIG. 5
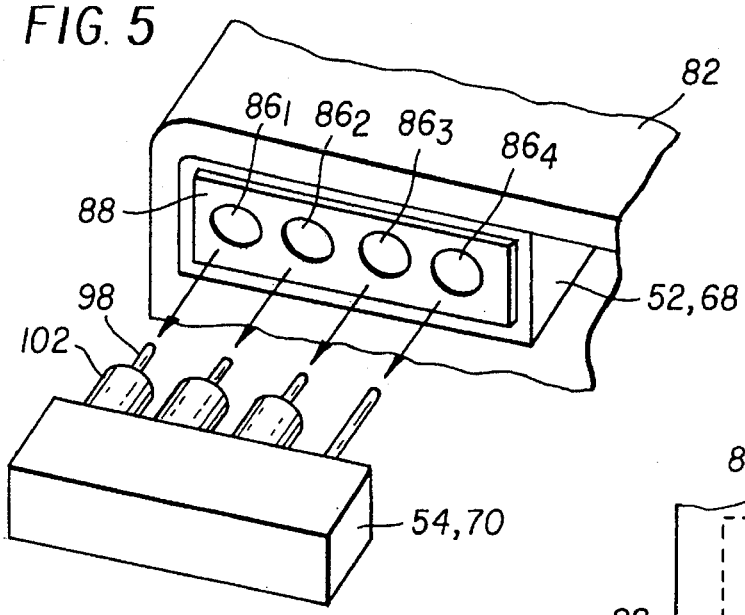
FIG. 7
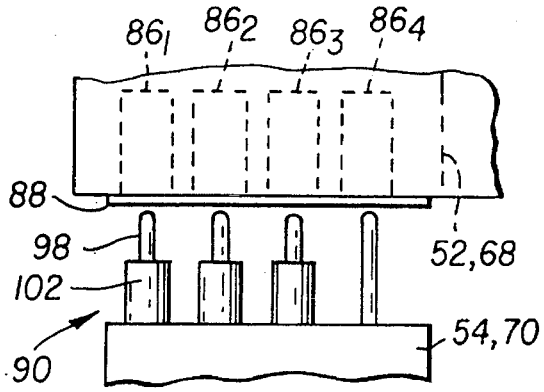
FIG. 8
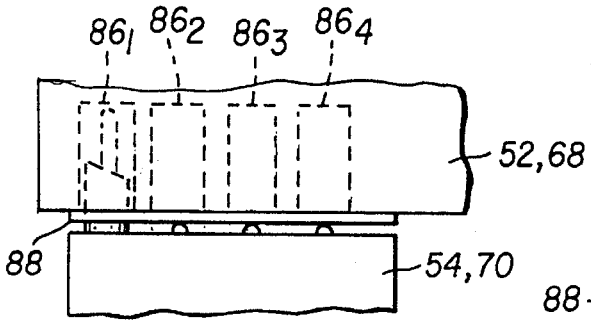
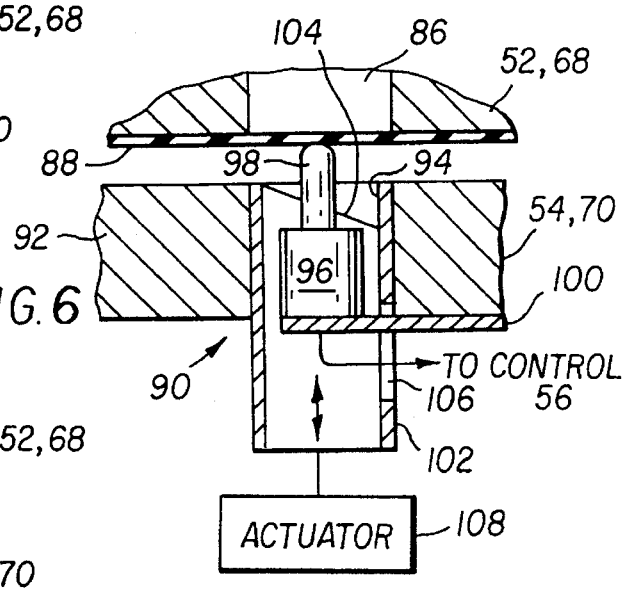
FIG. 6
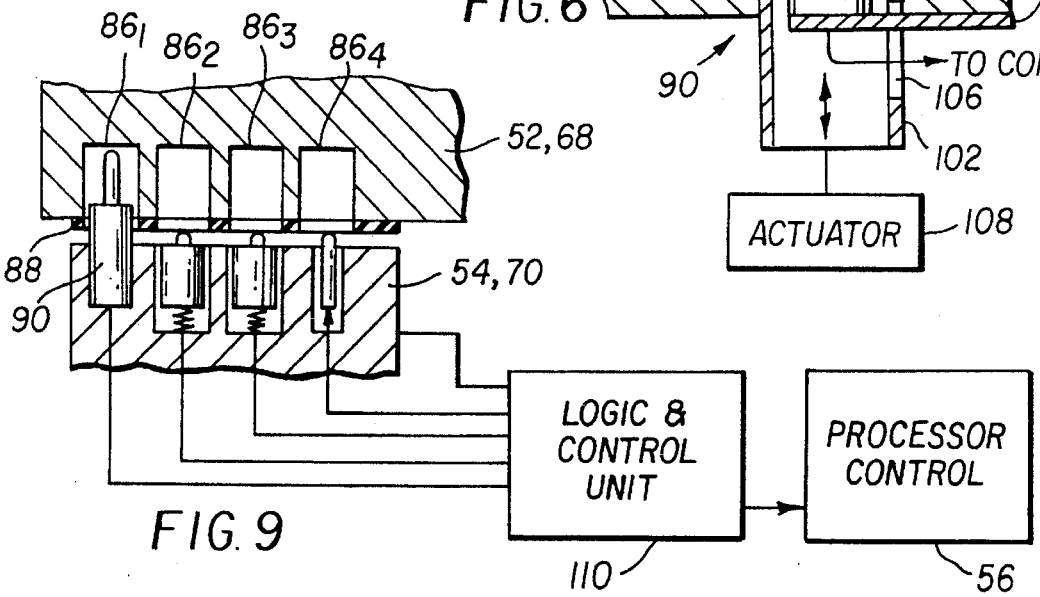
FIG. 9

SYSTEM AND METHOD FOR TRANSFERRING A FLUID BETWEEN A CONTAINER AND AN ASSOCIATED APPARATUS FOR USING THE FLUID

FIELD OF THE INVENTION

The invention relates to a system and method for transferring a fluid between a container and an apparatus which uses the fluid. The invention particularly concerns a system and method for delivering liquid photographic processing chemicals from individual containers stored in separate compartments to a photographic processor apparatus and receiving effluent chemicals from the processor into emptied containers, while minimizing the possibility of delivering an incorrect liquid chemical from a container to the processor or receiving an effluent from the processor to a container holding fresh chemicals.

BACKGROUND OF THE INVENTION

Many types of equipment, such as photographic processor apparatus, require that a certain processing fluid be at least periodically delivered to the apparatus. Some such apparatus also require that effluent fluids be received from the apparatus. Photographic processor apparatus, in particular, require that liquid processing chemicals be added to the apparatus either to replenish liquids already in the apparatus or to provide a completely fresh batch of liquids to the apparatus. Similarly, spent or effluent processing chemicals must be received from the apparatus from time to time.

Various techniques are known for delivering liquid chemicals to photographic processors. Many involve the use of tanks where chemical concentrates are mixed with water. In other techniques, chemical concentrates are fed directly into the processor by a metering device and are mixed in the processor itself by the action of the pumps and filters. In the latter case, the chemical concentrates typically are supplied from cubitainers, drums, or bag-in-the-box containers.

At least two significant problems may occur when supplying chemicals to processors using either of these techniques. First, the known techniques provide quite an opportunity for spills and leaks. Second, the known techniques provide an opportunity for mixing or feeding the wrong chemicals into the processor or for delivering the chemicals improperly within the processor. In the latter regard, current processors known as minilabs have tanks in which the chemical concentrates are poured and then mixed with water. This provides an opportunity for several errors. The concentrates and water may be mixed incorrectly due to their being added to the tank in the wrong order. The wrong concentrates may be added. The wrong quantity of water may be added. The concentrates and water may be mixed in the wrong tank, such as bleach replenisher in the developer replenisher tank. There are currently no commercially available processors having features to prevent or substantially lessen the probability of such errors.

One attempt to solve the problem of adding the wrong chemical concentrates is to color code the bottles so they match the tanks into which they are to be poured in the processor. Another attempt has been to match the shape of the bottle to the shape of the inlet of the tank into which the bottle is to be placed. Even these methods leave a significant margin for error.

Accordingly a need has long been recognized for a system and method for transferring fluid between a container and an associated apparatus, while minimizing the possibility of delivering the wrong fluids to the apparatus.

SUMMARY OF THE INVENTION

It is, therefore, an object of the present invention to provide a system and method for delivering a particular fluid to a photographic processor apparatus with minimal opportunity to misdeliver the fluid.

Still another object of the invention is to provide a system and method for delivering a fluid between a container and an apparatus for using the fluid, with minimal possibility for delivering the wrong fluid.

Yet another object of the invention is to provide a system that uses sensors and a microprocessor for ensuring delivery of the correct fluid between a container and an apparatus for using the fluid.

Our invention is defined by the claims. Our system is particularly suited for delivering fluid between at least one container for fluid and an associated apparatus for using fluid. The system may include at least one container for fluid; a first status code member associated with the container to indicate whether the container has been opened; a second status code member associated with the container to indicate whether or not the container has been emptied of a first fluid; and a third status code member associated with the container to indicate a type of the first fluid. To determine the condition of the status code members, our system also may include a first sensor associated with the apparatus to cooperate with the first status code member and produce a first signal indicative of an opened or unopened container; a second sensor associated with the apparatus to cooperate with the second status code member and produce a second signal indicative of a container emptied of a first fluid; and a third sensor associated with the apparatus to cooperate with the third status code member and produce a third signal indicative of a type of fluid. A controller is provided for receiving and processing the first to third signals to determine whether the proper container has been installed to deliver the first fluid to the apparatus.

Our system also may include a fourth status code member associated with the container to indicate whether the container has been refilled with a second fluid; a fourth sensor associated with the apparatus to cooperate with the fourth status code member and produce a fourth signal indicative of a container refilled with the second fluid; the controller also receiving and processing the fourth signal to determine whether the proper container has been installed to receive the second fluid from the apparatus.

The first, second and fourth status code members preferably are alterable; and our system may also include a first, selectively operable code change member associated with the apparatus for altering the first status code member from a closed container configuration to an opened container configuration; a second, selectively operable code change member associated with the apparatus for altering the second status code member from a full container configuration to an emptied container configuration; a third, selectively operable code change member associated with the apparatus for altering the fourth status code member from a container with the first fluid configuration to a container with the second fluid configuration. The first, second and third code change members are operatively connected to and selectively operable by the controller. In one embodiment of our system, each status code member may include a recess in the container and a puncturable membrane across the recess; each sensor may include a movable probe for engaging an intact membrane or entering the recess through a broken membrane; and each code change member may include a moveable piercer for breaking the membrane. In a preferred embodiment, the first fluids are liquid photoprocessing chemicals; the apparatus is a photographic processor; and the second fluids are spent chemicals from the processor.

Our method may include the steps of providing at least one container for photographic processor chemicals; providing a first status code member associated with the container to indicate whether the container has been opened; providing a second status code member associated with the container to indicate whether or not the container has been emptied of a first liquid; providing a third status code member associated with the container to indicate a type of the first liquid; sensing a condition of the first status code member and producing a first signal indicative of an opened or unopened container; sensing a condition of the second status code member and producing a second signal indicative of a container emptied of a first liquid; sensing a condition of the third status code member and producing a third signal indicative of a type of the first liquid; processing the first to third signals to determine whether a proper container has been sensed for delivery of the first liquid to the photoprocessor; and delivering the first liquid to the photoprocessor when the proper container has been sensed.

Our method also may include the steps of providing a fourth status code member associated with the container to indicate whether the container has been refilled with a second liquid from the photoprocessor; sensing a condition of the fourth status code member and producing a fourth signal indicative of a container for receipt of the second liquid from the photoprocessor; processing the fourth signal to determine whether a proper container has been sensed to receive the second liquid from the photoprocessor; and receiving the second liquid from the photoprocessor when the proper container has been sensed.

When the first, second and fourth status code members are alterable, our method also may include the steps of, after beginning the delivering step, altering the first status code member from a closed container configuration to an opened container configuration; after completing the delivering step, altering the second status code member from a full container configuration to an emptied container configuration; and after beginning the receiving step, altering the fourth status code member from a container with the first liquid configuration to a container with the second liquid configuration. When each status code member comprises a recess in the container and a puncturable membrane across the recess; each sensing step determines the status of the membrane; and each altering step punctures the membrane.

Accordingly, important advantageous effects of the present invention are that it provides an interface between a photographic processor apparatus and supply cartridge for fluid chemicals. The interface and a controller in the processor are effective to prevent a user from leaving a container installed at the wrong location in the processor; to identify a type of cartridge being used; and to signal the operator of the processor whether a cartridge is (i) full or partially full of fresh fluid, (ii) empty, or (iii) full or partially full of effluent from the processor. Another important advantageous effect of the system of the present invention is that the interface between the container and the processor communicates with the controller of the processor to prevent delivery of chemicals from an incorrect cartridge.

BRIEF DESCRIPTION OF THE DRAWINGS

The foregoing as well as other objects, features and advantages of this invention will become more apparent from the appended Figures, wherein like reference numerals denote like elements, and wherein:

FIG. 5 shows a fragmentary, exploded, perspective view of the interface between the cartridge and the processor;

FIG. 6 shows a schematic sectional view of one embodiment of the interface;

FIG. 7 shows a schematic, fragmentary, plan view of the interface of FIG. 5, just as the sensor probes of the processor are about to engage the cartridge;

FIG. 8 shows the apparatus of FIG. 7 after the cartridge has engaged fully with the processor and one sensor probe has been extended;

FIG. 9 shows a sectional view of the apparatus of FIG. 7 plus associated logic and control modules;

DETAILED DESCRIPTION OF THE INVENTION

Figure 1:
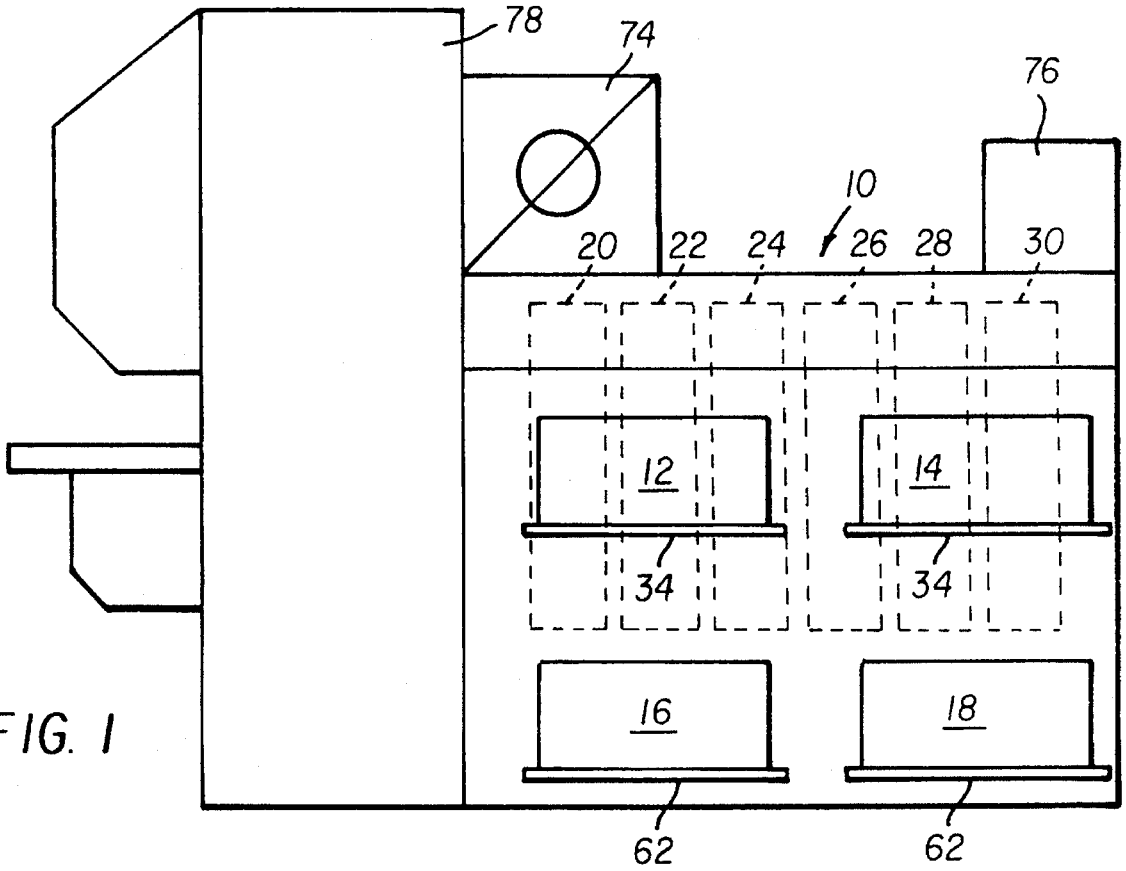
FIG. 1 shows a schematic side elevation view of a photographic processor apparatus of a general type in which the system and method of our invention may be used.

The following is a detailed description of the preferred embodiments of the invention, reference being made to the drawings in which the same reference numerals identify the same elements of structure in each of the several Figures.

Figure 2:
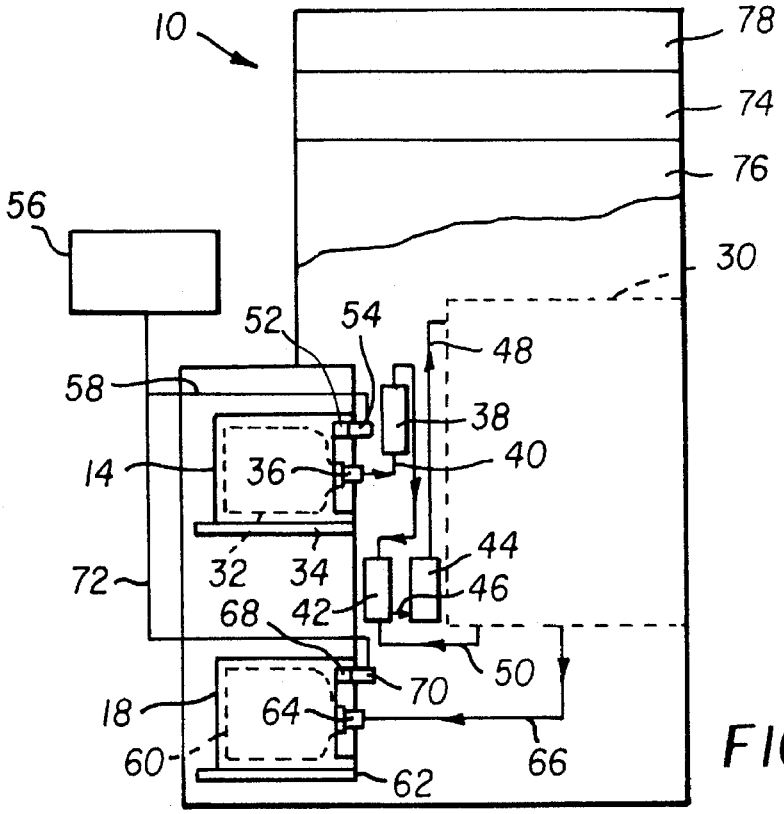
FIG. 2 shows a schematic end elevation view, partially broken away, from the right as viewed in FIG. 1.

Referring to FIGS. 1 and 2, a photographic processor apparatus 10 is shown which may be provided with cartridges 12, 14 for delivery of fresh liquid chemicals to the processor and cartridges 16, 18 for receipt of spent chemical effluents from the processor. In the conventional manner, processor 10 includes, as shown in phantom lines, a developer tank 20, a bleach tank 22, a fix tank 24 and stabilizer tanks 26, 28, 30.

In the illustrated embodiment, each cartridge 12, 14 comprises one or more internal, flexible bags 32 and each cartridge is supported on a shelf 34. Flow of liquid from each flexible bag is controlled by a corresponding two-part valve 36 of the type shown in copending, commonly assigned U.S. patent application Ser. No. 08/220,984 filed 31 Mar. 1994 by Clark E. Harris and David L. Patton, the contents of which are hereby incorporated by reference. One part of each valve 36 is installed on the cartridge and the other, mating part is installed in the processor in position to mate with the first part when the cartridge is fully installed. Once the parts of valve 36 have mated, liquid is pumped from cartridge 14 by a replenishment pump 38 through a conduit 40. A recirculation pump 42 receives the output from pump 38 and discharges to a filter and heater assembly 44 through a conduit 46. From assembly 44, the liquid flows into an upper portion of tank 30 through a conduit 48. A conduit 50 at the bottom of tank 30 directs a portion of the contents of the tank back to pump 42 for recirculation and mixing. When replenishment pump is stopped, liquid can be recirculated continuously or intermittently through a circuit comprising recirculation pump 42, conduit 46, assembly 44, conduit 48, tank 30 and conduit 50. A similar liquid delivery system is provided for cartridge 12.

To ensure that the correct cartridge is connected to tanks 20 to 30, each cartridge 12, 14 includes an interface block 52 which mates with a corresponding sensor probe assembly 54 in the processor, preferably before the parts of valve 36 have mated. A programmable controller 56 for the processor receives signals from each probe assembly 54 over a cable 58. Beneath cartridges 12, 14, each cartridge 16, 18 also includes at least one flexible bag 60 for receiving effluents from the processor. Cartridges 16, 18 are installed on respective shelves 62. Each cartridge 16, 18 also comprises one part of a control valve assembly 64, the mating part of the valve being installed in the processor. An overflow conduit 66 leads from the bottom of each tank 20 to 30 to a corresponding valve assembly 64 to enable each cartridge 16, 18 to receive effluents. As in the case of cartridges 12, 14, an interface block 68 on cartridge each cartridge 16, 18 mates with a corresponding sensor probe assembly 70 in the processor, preferably before the parts of valve 64 have mated. A cable 72 delivers signals from each assembly 70 to controller 56. In the conventional manner, processor 10 also includes a photographic paper supply 74, a dryer 76 and a printer 78, which form no part of the present invention.

In operation of processor 10, a cartridge is placed on a shelf in the processor; so that, the interface block on the cartridge engages the sensor probe assembly in the processor, preferably before the parts of valve 36, 64 have mated. Controller 56 determines, using logic to be discussed later in this specification, whether the cartridge is the proper one to deliver fresh liquid to tanks 22 to 24 or to 26 to 28; or to receive effluent from the processor. A cartridge placed in the wrong location will cause the controller to signal the operator to remove and replace the cartridge. Once a cartridge of fresh liquid is properly placed and the parts of the corresponding control valves are mated, the controller actuates the corresponding probe assembly to alter a portion of the interface block to indicate that the cartridge has been opened. When a cartridge has been emptied of fresh liquid, the probe assembly alters another portion of the interface block to indicate that the cartridge is empty. Once a cartridge has been properly placed to receive effluent and has been filled, the corresponding probe assembly alters still another portion of the interface block to indicate that the cartridge is full of effluent. Thus, in accordance with our invention, the interface block and probe assembly cooperate to provide signals to the controller to indicate if a cartridge is full of fresh liquid, contains a particular fresh liquid, is partially full of fresh liquid, is empty or partially full of effluent, or is full of effluent.

Figure 3:
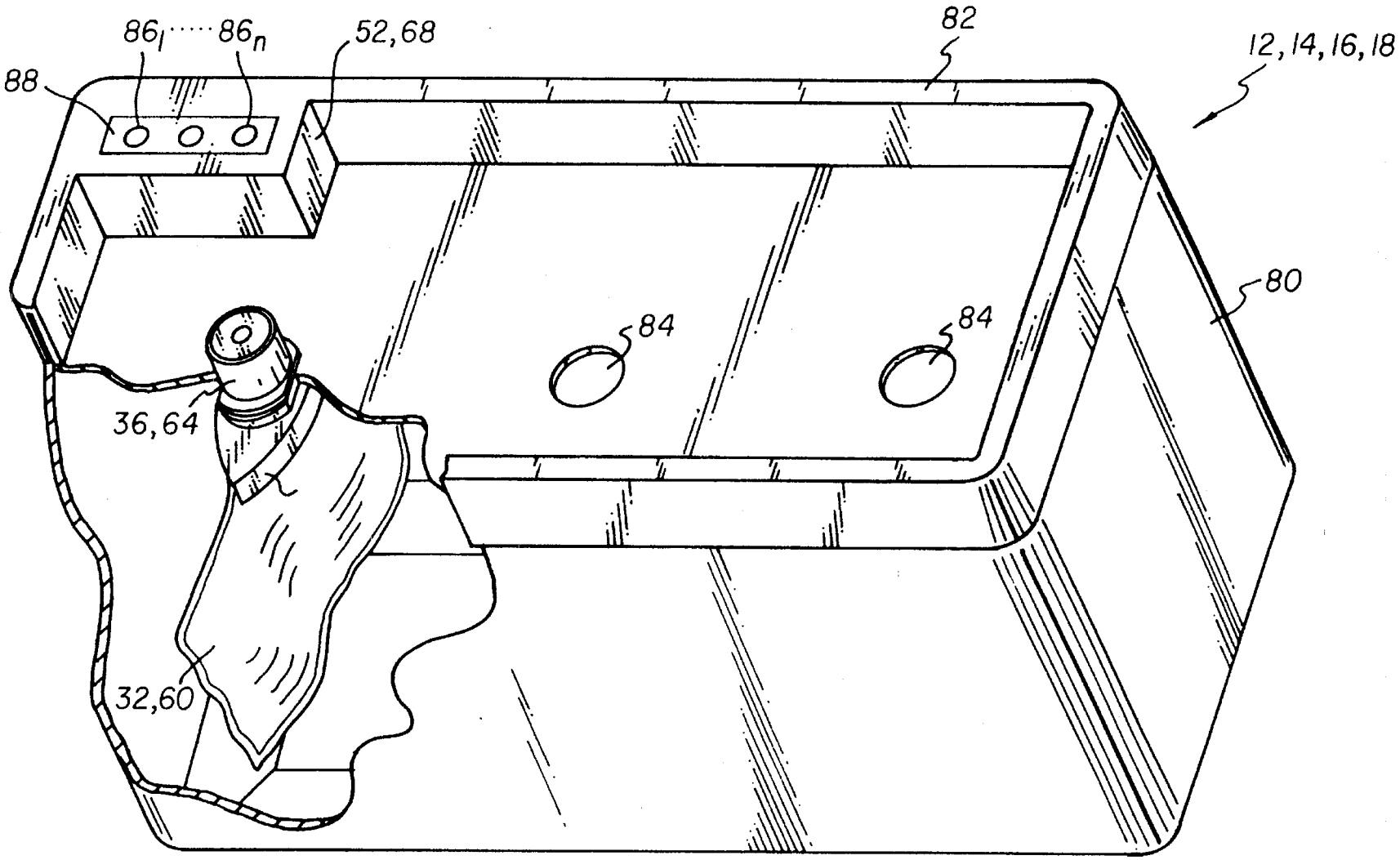
FIG. 3 shows a perspective view, partially broken away, of a cartridge for liquid chemicals according to our invention.
Figure 4:
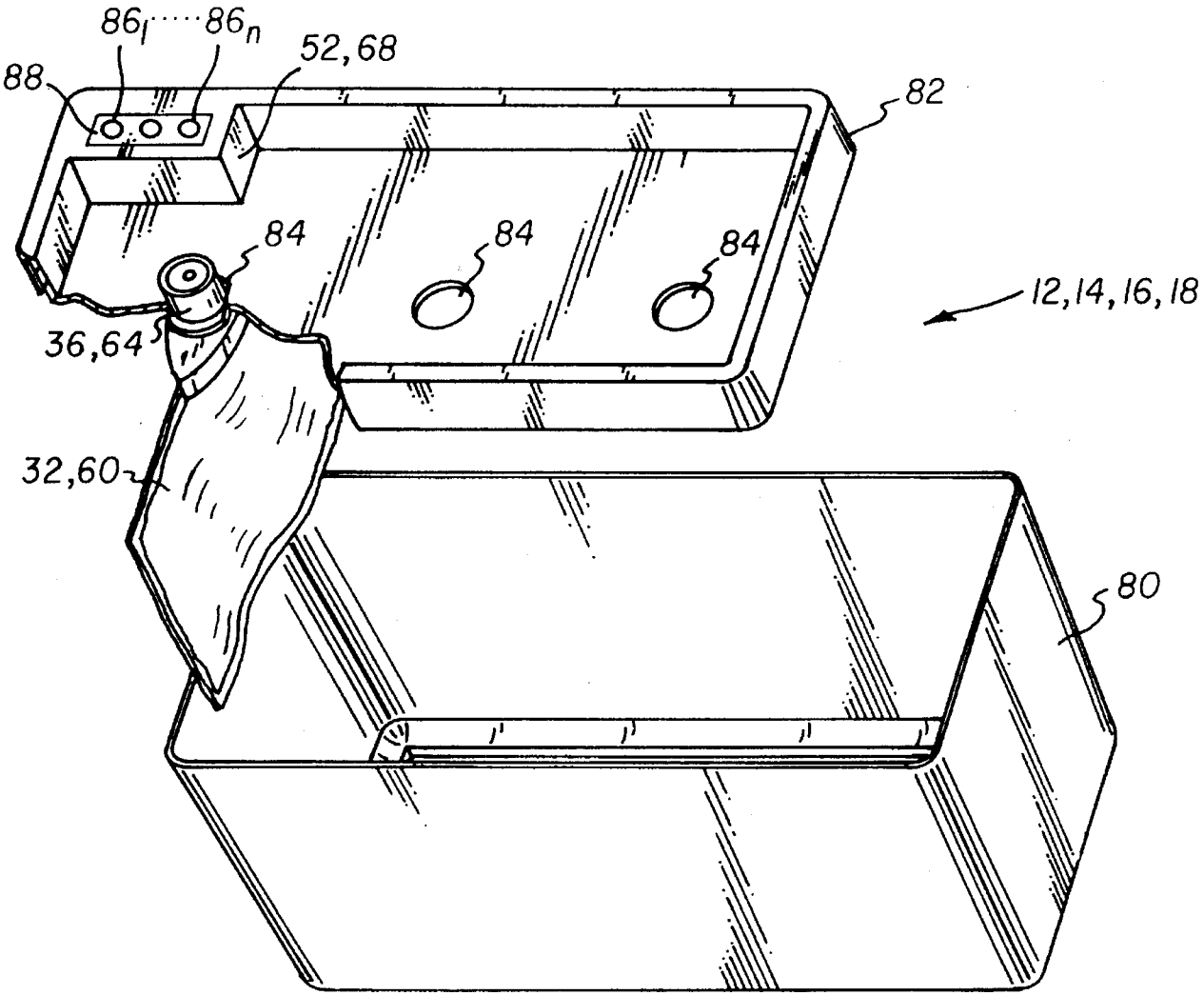
FIG. 4 shows an exploded perspective view of the cartridge of FIG. 3.

FIGS. 3 and 4 show the overall arrangement of cartridges 12 to 18 for use in accordance with the principles of our invention. Each cartridge may comprise an outer rigid container 80, a closure portion 82 removably mounted to container 80, at least one flexible bag 32, 60 which holds the processing chemicals, and flow control valve 36, 64 connected to the flexible bag. Each control valve has a neck portion which securely engages one of a corresponding plurality of spaced openings 84 in closure portion 82. Interface blocks 52, 68 may be provided at one corner of closure 82, or at any convenient location on the closure. A plurality of status code members such as bores or recesses or openings $\mathbf{86}_1 \ldots \mathbf{86}_n$, preferably four in number, are provided into block 52, 68 in any convenient pattern. Those skilled in the art will appreciate that the number of code members may be chosen to correspond with the number of characteristics of the cartridge to be monitored. As will be further discussed regarding FIGS. 12 to 16, when a cartridge is fresh and not yet inserted into a processor apparatus, a predetermined pattern of the code members 86 is closed by means such as a plastic membrane 88. In the illustrated embodiment, membrane 88 is shown to be transparent; however, this need not be.

The pattern of open and closed status code members thus can indicate the condition and contents of the cartridge. When a cartridge 12 to 18 is first placed on one of shelves 34, 62, interface block 52, 68 mates with the corresponding sensor probe assembly 54, 68 as shown progressively in FIGS. 5, 7 and 8. Initially, the sensor probe assembly simply senses the presence or absence of membrane 88 over each of status code elements 86. Whether membrane 88 is intact or punctured tells controller 56 the condition of the cartridge. For example, the presence of membrane 88 over element $\mathbf{86}_1$ would indicate an opened container of fresh liquid, while absence of the membrane would indicate a previously opened container. The presence of membrane 88 over element $\mathbf{86}_2$ would indicate a container not yet emptied of fresh liquid, while absence of the membrane would indicate a container emptied of fresh liquid. The presence of membrane 88 over element $\mathbf{86}_3$ would indicate a container not yet filled with effluent, while absence of the membrane would indicate a container filled with effluent. Finally, the presence of membrane 88 over element $\mathbf{86}_4$ would indicate a fill cartridge whose contents will be emptied to fill the processor, while absence of the membrane would indicate a run cartridge whose contents are used to replenish the processor. The membrane over element 864 typically would be punctured or left intact at the time the cartridge is originally filled.

As previously indicated, status code members 86 may be provided in a wide variety of patterns in addition to the simple linear array illustrated. Fewer or more status code members may be used. FIG. 7 shows schematically one type of switch and penetrator assembly 90 suitable for use in sensor probe assemblies 54, 70. A cover or support plate 92 is provided with a bore 94 within which a switch 96 is mounted. The switch is connected electrically to controller 56. An actuator plunger 98 extends axially from switch 96; so that, the plunger will make contact with membrane 88 when a cartridge is inserted and be forced into switch 96 to indicate the presence of the membrane. A support bracket or flange 100 positions switch 96. Slidably mounted in bore 94 and surrounding switch 96 is a cylindrical plunge knife 102, having an angled cutting edge 102 rather like an oversized hypodermic needle. An axially extending slot 106 in knife 102 allows passage of bracket 100 and permits the knife to move axially within the bore. An actuator 108, illustrated schematically, is connected mechanically to knife 102 and electrically to controller 56. When, knife 102 is extended, it punctures membrane 88 to alter the status code at that location.

Figure 17:
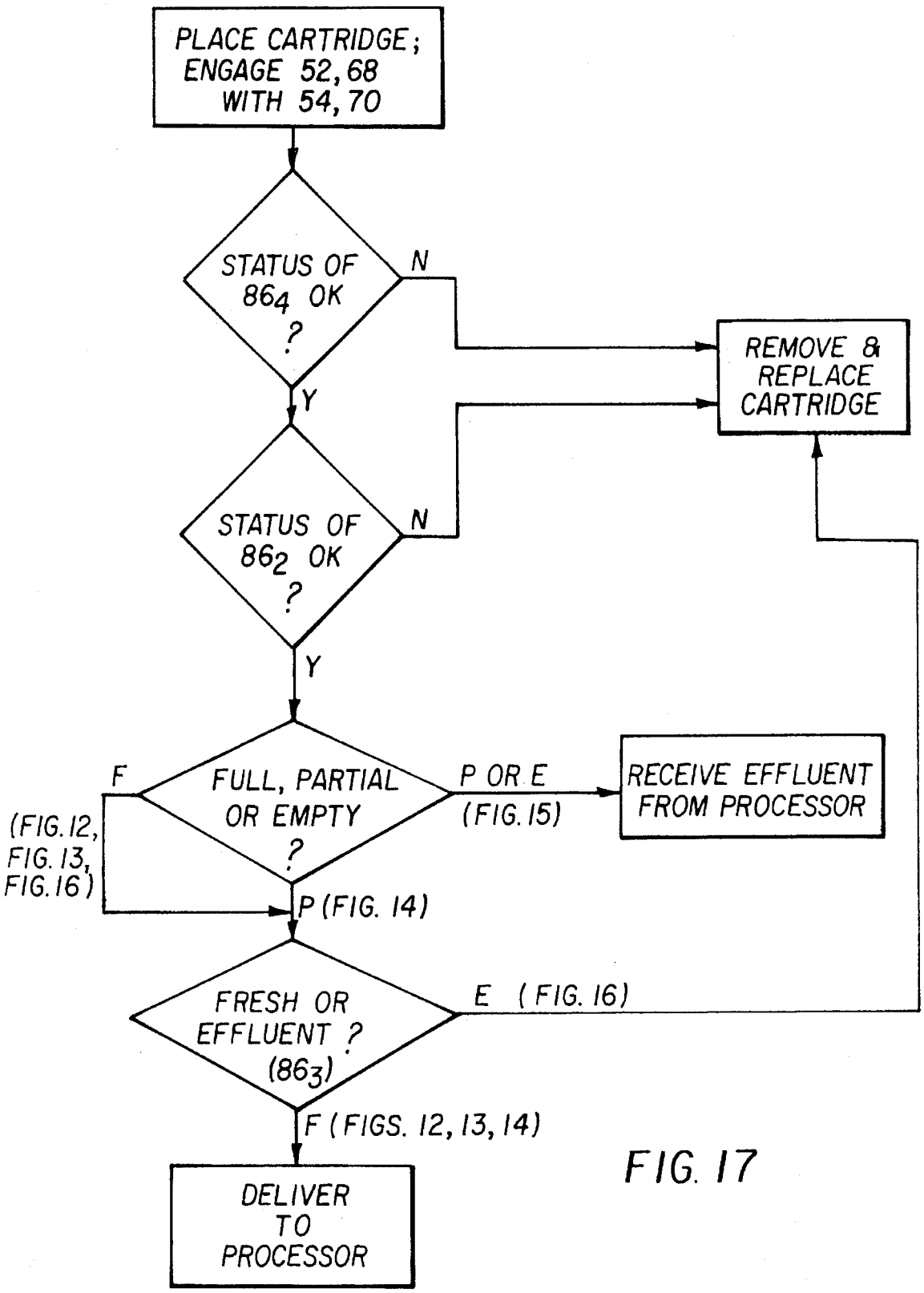
FIG. 17 shows a flow chart of logic processing steps executed by the microprocessor of the photographic processor apparatus.

FIGS. 5 to 7 show the interface block approaching the sensor probe assembly during installation of a cartridge. FIG. 17 illustrates the logic of operation of the system.

Figure 12:
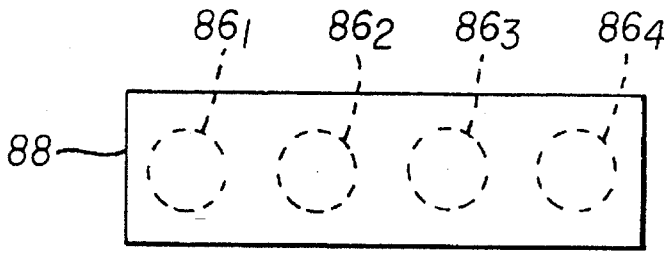
FIGS. 12 to 16 show various stages of use of the interface on the cartridge.
Figure 13:
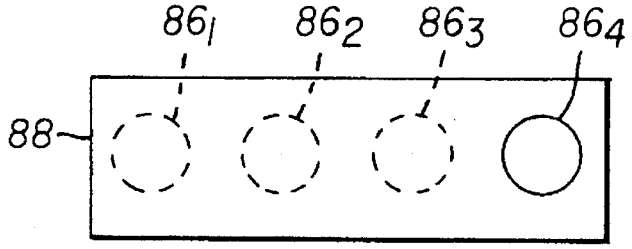

Initially, plunge knives 102 would be withdrawn, as shown in FIG. 7. Assuming that a cartridge of fresh chemicals is being installed, FIG. 12 shows the condition of membrane 88 for a fill cartridge; and FIG. 13, for a run cartridge with the membrane removed over status element $86_4$. As the cartridge is installed, each of switch plungers 98 is forced toward its switch 96 to signal controller 56 that the membrane is present or absent. The controller will detect from the condition of the membrane at status element $86_4$ that the cartridge is a fill or run cartridge. If the shelf should not receive that type of cartridge, the controller will signal the operator to remove and replace the cartridge. Note that no plunge knife is needed at location $86_4$, as shown schematically in FIGS. 5, 7 and 8. The controller will then check the condition of the membrane at status element $86_2$ to detect from the condition of the membrane whether or not the cartridge has been emptied of fresh liquid. An emptied cartridge would exhibit membrane 88 as in FIG. 15 and would belong on one of shelves 62. A not yet emptied cartridge would exhibit membrane 88 as in FIGS. 12 to 14 and would belong on one of shelves 34. If necessary, the controller will signal the operator to remove and replace the cartridge. The controller will then check the condition of the membrane at status element of all four status elements to detect whether the cartridge is full as in FIGS. 12, 13 or 16; partially full as in FIG. 14; or either partially full or empty as in FIG. 15. A configuration of FIG. 15 will indicate a cartridge that is empty or partially filled with effluent and ready to receive effluent from the processor. A configuration of FIGS. 12 to 14 will indicate a cartridge that is full or partially full with fresh liquid and ready to deliver fresh liquid to the processor. A configuration of FIG. 16 will indicate a cartridge that is full of effluent and should be removed and replace.

Figure 10:
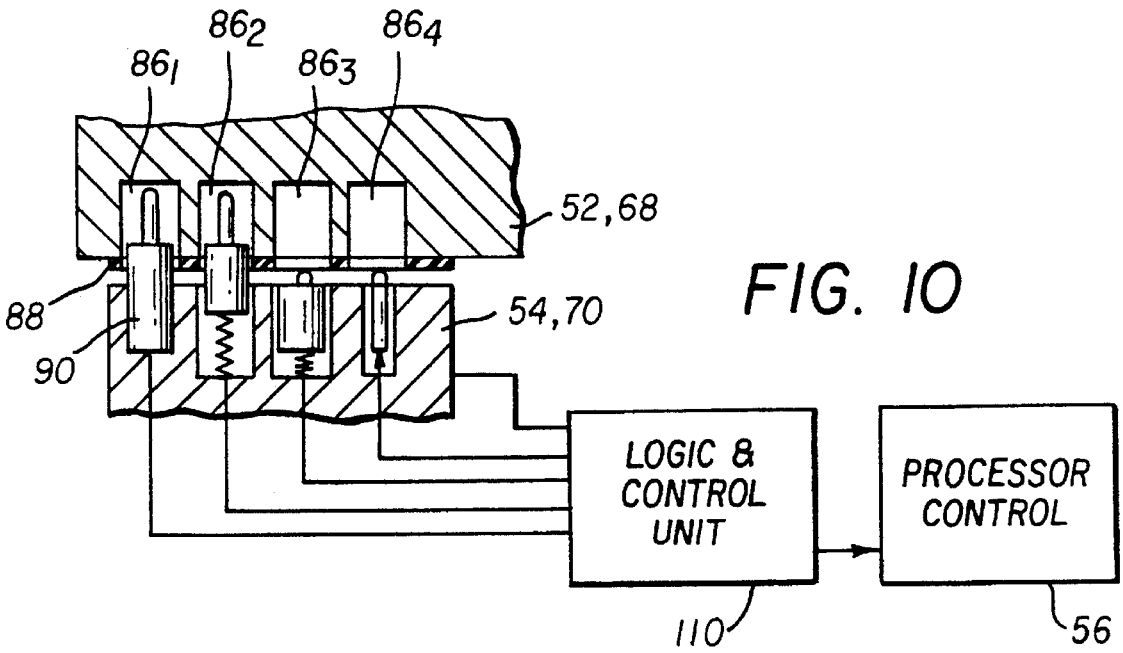
FIG. 10 shows a sectional view of the apparatus of FIG. 9, with a second sensor probe extended.
Figure 11:
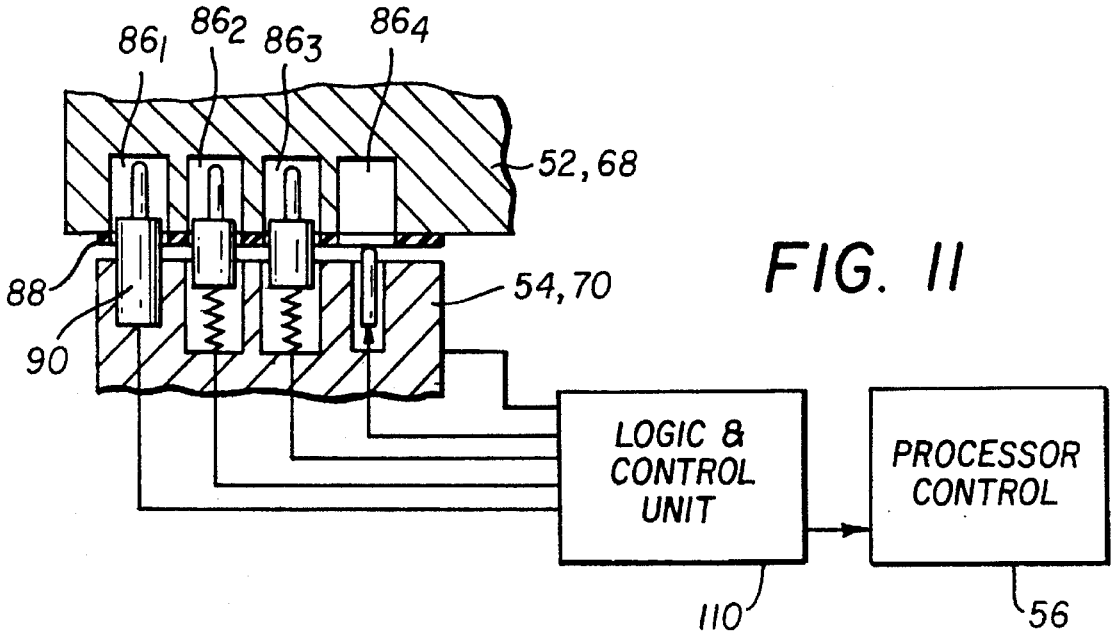
FIG. 11 shows a sectional view of the apparatus of FIG. 9 with a third sensor probe extended.
Figure 14:
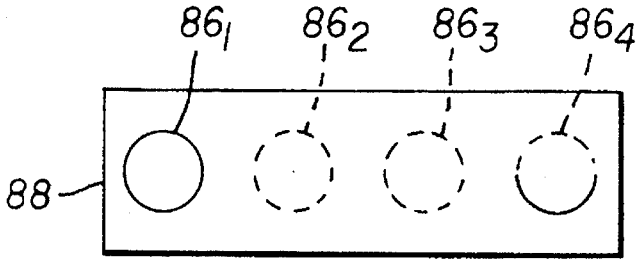
Figure 15:
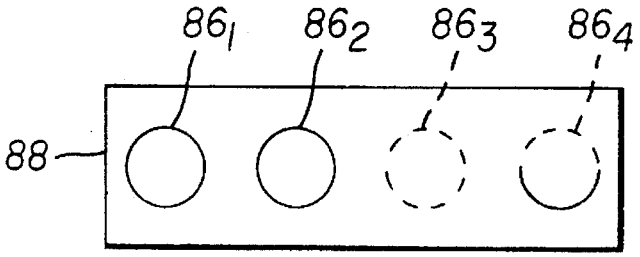
Figure 16:
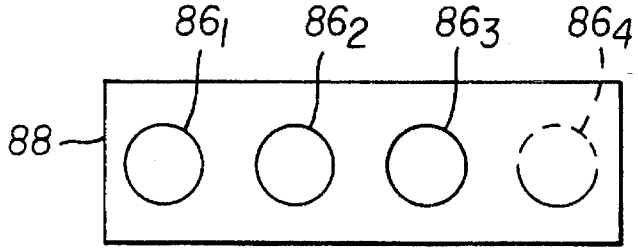

When the processor is ready to receive fresh liquid from a full cartridge, as shown in FIG. 9, the controller actuates the plunge knife for location $86_1$, which then pierces the membrane to produce the configuration of FIG. 14. When the cartridge has been emptied, as shown in FIG.10, the controller actuates the plunge knife for location $86_2$ to produce the configuration of FIG. 15. Conventional techniques, such as optical sensors or weighers, not illustrated, are used to detect an empty cartridge 12, 14.The cartridge is now ready for use to receive effluent. When a cartridge on one of shelves 62 is ready to receive effluent, the controller allows effluent to drain away to the cartridge. Conventional techniques, as previously mentioned, are used to detect a cartridge 16, 18 full of effluent. Once the cartridge is full of effluent, as shown in FIG. 11, the controller actuates the plunge knife at location $86_3$ to produce the configuration of FIG. 16.

Parts List

10 . . . photographic processor apparatus
12, 14, 16, 18 . . . cartridges for liquid chemicals
20 . . . developer tank
22 . . . bleach tank
24 . . . fix tank
26, 28, 30 . . . stabilizer tanks
32 . . . flexible bag within 14, 16
34 . . . shelf for 14, 16
36 . . . flow control valve
38 . . . replenishment pump
40 . . . conduit
42 . . . recirculation pump
44 . . . filter and heater assembly
46 . . . conduit to 44 from 42
48 . . . conduit to top of 30 from 44
50 . . . conduit from bottom of 30 to 42
52 . . . interface block on 14, 16
54 . . . sensor probe assembly
56 . . . programmable controller for 10
58 . . . cable
60 . . . flexible bag within 18, 20
62 . . . shelf for 18
64 . . . flow control valve
66 . . . overflow conduit from 30 to 64
68 . . . interface block on 18, 20
70 . . . sensor probe assembly
72 . . . cable
74 . . . photographic paper supply
76 . . . dryer
78 . . . printer
80 . . . outer rigid container
82 . . . closure
84 . . . openings in 82
$86_1$ . . . $86_n$ . . . status code bores in 52, 68
88 . . . membrane over $86_1$ . . . $86_n$
90 . . . switch and penetrator assembly
92 . . . cover plate
94 . . . bore
96 . . . switch
98 . . . plunger to engage
100 . . . support bracket
102 . . . cylindrical plunge knife
104 . . . angled cutting edge
106 . . . slot in 102
108 . . . actuator for 102
110 . . . logic and control module Our invention has therefore been described with reference to certain embodiments thereof, but it will be understood by persons skilled in the art that variations and modifications can be effected without departing from the scope of our invention.

Having described our invention in sufficient detail to enable those skilled in the art to make and use it, we claim:

1. A system for delivering fluid between at least one container for fluid and an associated apparatus for using fluid, the system comprising:

at least one container for fluid;

a first status code member associated with the container to indicate whether the container has been opened;

a second status code member associated with the container to indicate whether or not the container has been emptied of a first fluid;

a third status code member associated with the container to indicate a type of the first fluid;

a first sensor associated with the apparatus to cooperate with the first status code member and produce a first signal indicative of an opened or unopened container;

a second sensor associated with the apparatus to cooperate with the second status code member and produce a second signal indicative of a container emptied of a first fluid;

a third sensor associated with the apparatus to cooperate with the third status code member and produce a third signal indicative of a type of fluid; and a controller for receiving and processing the first to third signals to determine whether the proper container has been installed to deliver the first fluid to the apparatus.

2. A system according to claim 1, further comprising:

a fourth status code member associated with the container to indicate whether the container has been refilled with a second fluid;

a fourth sensor associated with the apparatus to cooperate with the fourth status code member and produce a fourth signal indicative of a container refilled with the second fluid;

the controller also receiving and processing the fourth signal to determine whether the proper container has been installed to receive the second fluid from the apparatus.

3. Apparatus according to claim 2, wherein the first, second and fourth status code members are alterable, further comprising:

a first, selectively operable code change member associated with the apparatus for altering the first status code member from a closed container configuration to an opened container configuration;

a second, selectively operable code change member associated with the apparatus for altering the second status code member from a full container configuration to an emptied container configuration;

a third, selectively operable code change member associated with the apparatus for altering the fourth status code member from a container with the first fluid configuration to a container with the second fluid configuration;

the first, second and third code change members being operatively connected to and selectively operable by the controller.

4. A system according to claim 3, wherein each status code member comprises a recess in the container and a puncturable membrane across the recess; each sensor comprises a movable probe for engaging an intact membrane or entering the recess through a broken membrane; and each code change member comprises a moveable piercer for breaking the membrane.

5. A system according to claim 1, wherein each status code member comprises a recess in the container and a puncturable membrane across the recess; and each sensor comprises a movable probe for engaging an intact membrane or entering the recess through a broken membrane.

6. A system according to claim 2, wherein the first fluids are liquid photoprocessing chemicals; the apparatus is a photographic processor; and the second fluids are spent chemicals from the processor.

7. A system according to claim 3, wherein the first fluids are liquid photoprocessing chemicals; the apparatus is a photographic processor; and the second fluids are spent chemicals from the processor.

8. A system according to claim 4, wherein the first fluids are liquid photoprocessing chemicals; the apparatus is a photographic processor; and the second fluids are spent chemicals from the processor.

9. A system according to claim 1, wherein the first fluids are liquid photoprocessing chemicals; and the apparatus is a photographic processor.

10. A system according to claim 5, wherein the first fluids are liquid photoprocessing chemicals; and the apparatus is a photographic processor.

11. A method of delivering liquid photoprocessing chemicals to a photographic photoprocessor, comprising the steps of:

providing at least one container for the chemicals;

providing a first status code member associated with the container to indicate whether the container has been opened;

providing a second status code member associated with the container to indicate whether or not the container has been emptied of a first liquid;

providing a third status code member associated with the container to indicate a type of the first liquid;

sensing a condition of the first status code member and producing a first signal indicative of an opened or unopened container;

sensing a condition of the second status code member and producing a second signal indicative of a container emptied of a first liquid;

sensing a condition of the third status code member and producing a third signal indicative of a type of the first liquid;

processing the first to third signals to determine whether a proper container has been sensed for delivery of the first liquid to the photoprocessor; and delivering the first liquid to the photoprocessor when the proper container has been sensed.

12. A method according to claim 11, further comprising the steps of:

providing a fourth status code member associated with the container to indicate whether the container has been refilled with a second liquid from the photoprocessor;

sensing a condition of the fourth status code member and producing a fourth signal indicative of a container for receipt of the second liquid from the photoprocessor;

processing the fourth signal to determine whether a proper container has been sensed to receive the second liquid from the photoprocessor; and receiving the second liquid from the photoprocessor when the proper container has been sensed.

13. A method according to claim 12, wherein the first, second and fourth status code members are alterable, further comprising the steps of:

after beginning the delivering step, altering the first status code member from a closed container configuration to an opened container configuration;

after completing the delivering step, altering the second status code member from a full container configuration to an emptied container configuration; and after beginning the receiving step, altering the fourth status code member from a container with the first liquid configuration to a container with the second liquid configuration.

14. A method according to claim 13, wherein each status code member comprises a recess in the container and a puncturable membrane across the recess; each sensing step determines the status of the membrane; and each altering step punctures the membrane.

15. A method according to claim 11, wherein each status code member comprises a recess in the container and a puncturable membrane across the recess; and each sensing step determines the status of the membrane.

16. A delivery system between at least one container and an associated apparatus, the system comprising:

at least one container;

a first status code member associated with the container to indicate whether the container has been opened;

a second status code member associated with the container to indicate whether or not the container has been emptied;

a third status code member associated with the container to indicate a type of contents of the container;

a first sensor associated with the apparatus to cooperate with the first status code member and produce a first signal indicative of an opened or unopened container;

a second sensor associated with the apparatus to cooperate with the second status code member and produce a second signal indicative of an emptied container;

a third sensor associated with the apparatus to cooperate with the third status code member and produce a third signal indicative of a type of contents of the container; and a controller for receiving and processing the first to third signals to determine whether the proper container has been installed to deliver to the apparatus.

* * * * *